US009165549B2

(12) United States Patent
Van Leest

(10) Patent No.: US 9,165,549 B2
(45) Date of Patent: Oct. 20, 2015

(54) AUDIO NOISE CANCELLING

(75) Inventor: Adriaan Johan Van Leest, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 231 days.

(21) Appl. No.: 13/319,532

(22) PCT Filed: May 4, 2010

(86) PCT No.: PCT/IB2010/051936

§ 371 (c)(1),
(2), (4) Date: Nov. 9, 2011

(87) PCT Pub. No.: WO2010/131154

PCT Pub. Date: Nov. 18, 2010

(65) Prior Publication Data

US 2012/0057720 A1 Mar. 8, 2012

(30) Foreign Application Priority Data

May 11, 2009 (EP) ..... 09159895

(51) Int. Cl.
*G10K 11/16* (2006.01)
*G10K 11/178* (2006.01)
(Continued)

(52) U.S. Cl.
CPC .... *G10K 11/1782* (2013.01); *G10K 2210/1081* (2013.01); *G10K 2210/3026* (2013.01);
(Continued)

(58) Field of Classification Search
CPC .... H04R 25/45; H04R 25/453; H04R 1/1083; H04B 3/08; H04B 3/23; H04B 3/32; H04B 3/235–3/238; G10K 11/1782; G10K 2210/3026; G10K 2210/51; G10K 2210/503; G10K 2210/1081; G10K 2210/3028; G10K 11/00; G10K 11/175
USPC ..... 381/71.1–71.14
See application file for complete search history.

(56) References Cited

U.S. PATENT DOCUMENTS 4,658,426 A * 4/1987 Chabries et al. ..... 381/94.3
5,848,169 A 12/1998 Clark, Jr. et al.
(Continued)

FOREIGN PATENT DOCUMENTS

EP 0654901 A1 5/1995
EP 0814456 A2 12/1997
(Continued)

OTHER PUBLICATIONS

Jean Laroche: "Optical Constraint-Based Loop-Shaping in the Cepstral Domain"; IEEE Signal Processing Letters, vol. 14, No. 4, Apr. 2007, pp. 225-227.

*Primary Examiner* — Davetta W Goins
*Assistant Examiner* — Oyesola C Ojo

(57) ABSTRACT

A noise canceling system comprises a microphone (103) for generating a captured signal representing sound in an audio environment and a sound transducer (101) for radiating a sound canceling audio signal in the audio environment. A feedback path (105, 107, 109, 111, 113) exists from the microphone (103) to the sound transducer (101) and comprises a feedback filter (109). A tone processor (119) determines a tone component characteristic for a tone component of a feedback signal of the feedback path (105, 107, 109, 111, 113) and an adaptation processor (121) adapts the feedback path in response to the tone component characteristic. The invention allows detection of the onset of instability and dynamic compensation to mitigate or prevent such instability. Accordingly increased design freedom for the feedback filter is achieved resulting in improved noise cancellation.

20 Claims, 9 Drawing Sheets

(51) Int. Cl.
*H04R 1/10* (2006.01)
*H04R 3/02* (2006.01)

(52) U.S. Cl.
CPC .. *G10K2210/3028* (2013.01); *G10K 2210/503* (2013.01); *G10K 2210/51* (2013.01); *H04R 1/1083* (2013.01); *H04R 3/02* (2013.01)

(56) References Cited

U.S. PATENT DOCUMENTS 5,937,070 A * 8/1999 Todter et al. ..... 381/71.6
5,940,519 A 8/1999 Kuo
6,097,823 A 8/2000 Kuo
6,278,786 B1 * 8/2001 McIntosh ..... 381/71.6
7,103,188 B1 9/2006 Jones
7,602,925 B2 * 10/2009 Kreifeldt et al. ..... 381/93
8,295,519 B2 * 10/2012 Elmedyb et al. ..... 381/318
8,422,691 B2 * 4/2013 Asada et al. ..... 381/71.1
2002/0003887 A1 1/2002 Zhang et al.
2010/0034398 A1 * 2/2010 Odent et al. ..... 381/71.11
2010/0189283 A1 * 7/2010 Sugai ..... 381/102

FOREIGN PATENT DOCUMENTS

JP H08510565 A 11/1996
JP 2007241104 9/2007
JP 2010016429 1/2010
WO 2008125774 A2 10/2008

* cited by examiner

AUDIO NOISE CANCELLING

FIELD OF THE INVENTION

The invention relates to an audio noise canceling system and in particular, but not exclusively, to an active audio noise canceling system for headphones.

BACKGROUND OF THE INVENTION

Active noise canceling is becoming increasingly popular in many audio environments wherein undesired sound is perceived by users. For example, headphones comprising active noise canceling functionality have become popular and are frequently used in many audio environments such as on noisy factory floors, in airplanes, and by people operating noisy equipment.

Active noise canceling headphones and similar systems are based on a microphone sensing the audio environment typically close to the users ear (e.g. within the acoustic volume created by the earphones around the ear). A noise cancellation signal is then radiated into the audio environment in order to reduce the resulting sound level. Specifically, the noise cancellation signal seeks to provide a signal with an opposite phase of the sound wave arriving at the microphone thereby resulting in a destructive interference that at least partly cancels out the noise in the audio environment. Typically, the active noise canceling system implements a feedback loop which generates the sound canceling signal based on the audio signal measured by the microphone in the presence of both the noise and the noise cancellation signal.

The performance of such noise cancellation loops is controlled by a feedback filter implemented as part of the feedback loop. The feedback filter is sought to be designed such that the optimum noise canceling effect can be achieved. Various algorithms and approaches for designing a feedback filter are known. For example, an approach for designing the feedback filter based on the Cepstral domain is described in J. Laroche. "Optimal Constraint-Based Loop-Shaping in the Cepstral Domain", IEEE Signal process. letters, 14(4):225 to 227, April 2007.

However, as the feedback loop essentially represents an Infinite Impulse Response (IIR) filter, the design of the feedback filter is constrained by the requirement for the feedback loop to be stable. The stability of the overall closed loop filter is guaranteed by using Nyquist' stability theorem which requires that the overall closed loop transfer function does not encircle the point $z=-1$ in the complex plane for $z=\exp(j\theta)$ with $0\leq\theta<2\pi$.

However, whereas the feedback filter tends to be a fixed, non-adaptive filter in order to reduce complexity and simplify the design process, the transfer functions of parts of the feedback loop tend to vary substantially. Specifically, the feedback loop comprises a secondary path which represents other elements of the loop than the feedback filter including the response of the analog to digital and digital to analog converters, anti-aliasing filters, power amplifier, loudspeaker, microphone and the transfer function of the acoustic path from the loudspeaker to the error microphone. The transfer function of the secondary path varies substantially as a function of the current configuration of the headphones. For example, the transfer function of the secondary path may change substantially depending on whether the headphones are in a normal operational configuration (i.e. worn by a user), are not worn by a user, are pressed towards the head of a user etc.

Since the feedback loop has to be stable in all scenarios, the feedback filter is restricted by having to ensure stability for all different possible transfer functions of the secondary path. Therefore, the design of the feedback filter tends to be based on a worst case assumption for the transfer function of the secondary path. However, although such an approach may ensure stability of the system, it tends to result in reduced performance as the ideal noise canceling function for the specific current secondary path transfer function is not implemented by the feedback filter.

Hence, an improved noise canceling system would be advantageous and in particular a noise canceling system allowing increased flexibility, improved noise cancellation, reduced complexity, improved stability performance and characteristics, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a noise canceling system comprising: a microphone for generating a captured signal representing sound in an audio environment; a sound transducer for radiating a sound canceling audio signal in the audio environment; a feedback path from the microphone to the sound transducer, the feedback path receiving the captured signal and generating a drive signal for the sound transducer and comprising a feedback filter; a tone processor for determining a tone component characteristic for a tone component of a feedback signal of the feedback path; and adaptation circuit for adapting the feedback path in response to the tone component characteristic.

The invention may provide improved performance for a noise canceling system. In many systems, the risk of instability may be reduced. In particular, instability may be avoided or reduced in many scenarios without requiring a feedback filter design based on a worst case feedback path and in particular based on a worst case transfer function of the secondary path. An adaptation of the feedback operation to the specific secondary path may often be achieved.

The invention may in many embodiments allow particularly efficient instability protection while maintaining low complexity and/or simple operation. A more flexible system and increased design freedom may typically be achieved.

The inventor has in particular realized that in many practical noise canceling systems, it is possible to detect the initial onset of an instability. Indeed, the inventor has realized that this can be detected by evaluating and considering signal components in the feedback path. Furthermore, the inventor has realized that evaluating and detecting tone signal components, such as specifically sine wave or approximate sine wave signal components, provide a good indication of a beginning instability in many noise canceling systems. Also, the inventor has realized that such instability can often be eliminated or mitigated by determining characteristics of tone signal components and modifying the feedback path in response.

The tone processor may comprise a tone detector for detecting a tone component in the feedback signal. The tone component characteristic may be a characteristic of the detected tone component. The tone component characteristic may e.g. be an amplitude, level, power, energy, frequency or phase of a tone component or may e.g. be the tone component itself.

In some embodiments, there may specifically be provided a noise canceling system comprising: a microphone for generating a captured signal representing sound in an audio environment; a sound transducer for radiating a sound canceling audio signal in the audio environment; a feedback path from the microphone to the sound transducer, the feedback path receiving the captured signal and generating a drive signal for the sound transducer and comprising a feedback filter; a tone signal component detector for generating a level indication of a signal level of a tone signal component in a feedback signal of the feedback path; and adaptation circuit for adapting the feedback filter in response to the level indication.

The adaptation circuit may specifically be arranged to adapt a transfer characteristic of the feedback path, such as a frequency response or gain of the feedback path from the microphone to the sound transducer.

In accordance with an optional feature of the invention, the tone component characteristic is a level indication of a signal level of the tone component.

This may provide a particularly advantageous noise canceling system. In particular, an estimated signal level of an estimated tone signal component may be determined and used to adapt the feedback path. The signal level of an estimated tone component may specifically be a particularly good indication of the stability or instability of the system.

In accordance with an optional feature of the invention, the adaptation circuit is arranged to adapt the feedback filter in response to the tone component.

This may provide a particularly advantageous noise canceling system. In particular, it may in many embodiments allow facilitated implementation or design and/or may provide an effective adaptation of the feedback path. In particular, it may allow effective automated stability compensation.

In accordance with an optional feature of the invention, the tone processor comprises an Adaptive Line Enhancer.

This may provide improved performance and/or facilitated implementation. In particular, an Adaptive Line Enhancer may provide particularly reliable and/or fast detection of the onset of tone components indicative of an instability arising.

In accordance with an optional feature of the invention, the Adaptive Line Enhancer comprises: an adaptive filter for delaying and filtering an input signal to generate a modified signal; a comparator for generating a difference indication by comparing the input signal to the modified signal; and circuit for adapting the adaptive filter to minimize the difference indication.

This may provide improved performance and/or facilitated implementation.

In accordance with an optional feature of the invention, the tone processor is arranged to generate the tone component characteristic in response to a characteristic of the modified signal.

This may provide a particularly advantageous noise canceling system. In particular, the modified signal may provide a signal with characteristics that provide a particularly good indication of the emergence of tone components due to the onset of instability.

In accordance with an optional feature of the invention, the tone processor is arranged to generate the tone component characteristic in response to a characteristic of at least one coefficient of the adaptive filter.

This may provide a particularly advantageous noise canceling system. In particular, the adaptive filter coefficient may provide a signal with characteristics that provide a particularly good indication of the emergence of tone components due to onset of instability.

In accordance with an optional feature of the invention, the adaptation circuit is arranged to adapt a gain of the feedback filter in response to the tone component characteristic.

This may provide improved performance and/or facilitated implementation. In particular, it may allow a low complexity yet highly efficient control, mitigation and/or prevention of instability.

In some embodiments, the feedback filter comprises a gain block and the adaptation circuit is arranged to adapt the gain of the gain block in response to the level indication. The gain block may provide a variable gain which is substantially (say within ±10%) constant within the operating frequency range of the system (say the 3 dB pass band). This may provide improved performance and/or facilitated implementation.

In accordance with an optional feature of the invention, the adaptation circuit is arranged to bias the gain towards lower gains for a tone component characteristic indicative of an increasing signal level of the tone signal component.

This may provide improved performance. In particular, it may allow highly efficient control, mitigation and/or prevention of instability.

In particular, the adaptation circuit may arranged to set the gain to a first value for a level indication below a first threshold, and to a second value for a level indication above a second threshold, the first value being higher than the second value. The first and second thresholds may be the same threshold or the first threshold may be lower than the second threshold.

In accordance with an optional feature of the invention, the system further comprises a filter to generate a filtered signal and wherein the tone processor is arranged to generate the tone component characteristic in response to the filtered signal.

This may provide a particularly advantageous noise canceling system. In particular, it may provide an improved reliability and may e.g. reduce the probability of falsely detecting an onset of instability. Accordingly, it may provide improved noise canceling in many scenarios.

The filter may specifically be a band pass filter and may typically be arranged to select a frequency interval in which the tone processor determines the tone component characteristic. The frequency interval may specifically be selected to correspond to a frequency range in which instability oscillations are likely to occur.

In some embodiments, the filter may be a filter corresponding to a combination of a plurality of band pass filters. In some embodiments, the tone signal component detector comprises a plurality of band pass filters each generating a filtered signal; circuit for generating a combined signal by combining the filtered signals and wherein the tone component processor is arranged to generate the tone characteristic indication in response to the combined signal. This may provide improved performance in many embodiments and may in particular be advantageous in applications wherein different instabilities are likely to occur resulting in different oscillation frequencies.

In accordance with an optional feature of the invention, the adaptation circuit is arranged to adapt a frequency response of the feedback filter.

This may provide improved performance in many embodiments. In particular, it may allow efficient instability mitigation or compensation with reduced degradation of the noise canceling performance for other noise. For example, the frequency response may be modified to reduce the gain experienced at the oscillation frequency while maintaining the gain at other frequencies.

In accordance with an optional feature of the invention, the noise canceling system further comprises suppression circuit for suppressing a signal component of the feedback signal, the signal component having a characteristic corresponding to the tone component characteristic.

This may provide a particularly advantageous noise canceling system. In particular, it may allow efficient instability mitigation, compensation and/or prevention.

In accordance with an optional feature of the invention, the tone processor and the adaptation circuit are part of an Adaptive Line Enhancer inserted in the feedback path.

This may provide a particularly advantageous noise canceling system. In particular, it may allow efficient instability mitigation, compensation and/or prevention. Specifically, an Adaptive Line Enhancer may provide particularly reliable and/or fast detection and suppression of the onset of tone components resulting from instability.

In accordance with an optional feature of the invention, the feedback path is an analog feedback path and at least part of the tone processor is implemented digitally.

This may provide a particularly efficient implementation in many embodiments.

In accordance with another aspect of the invention, there is provided a method of operation for a noise canceling system including: a microphone for generating a captured signal representing sound in an audio environment; a sound transducer for radiating a sound canceling audio signal in the audio environment; a feedback path from the microphone to the sound transducer, the feedback path receiving the captured signal and generating a drive signal for the sound transducer and comprising a feedback filter; the method comprising: determining a tone component characteristic for a tone component of a feedback signal of the feedback path; and adapting the feedback path in response to the tone component characteristic.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to an audio noise canceling system for a headphone. However, it will be appreciated that the invention is not limited to this application but may be applied to many other applications including for example noise canceling for vehicles.

Figure 1:
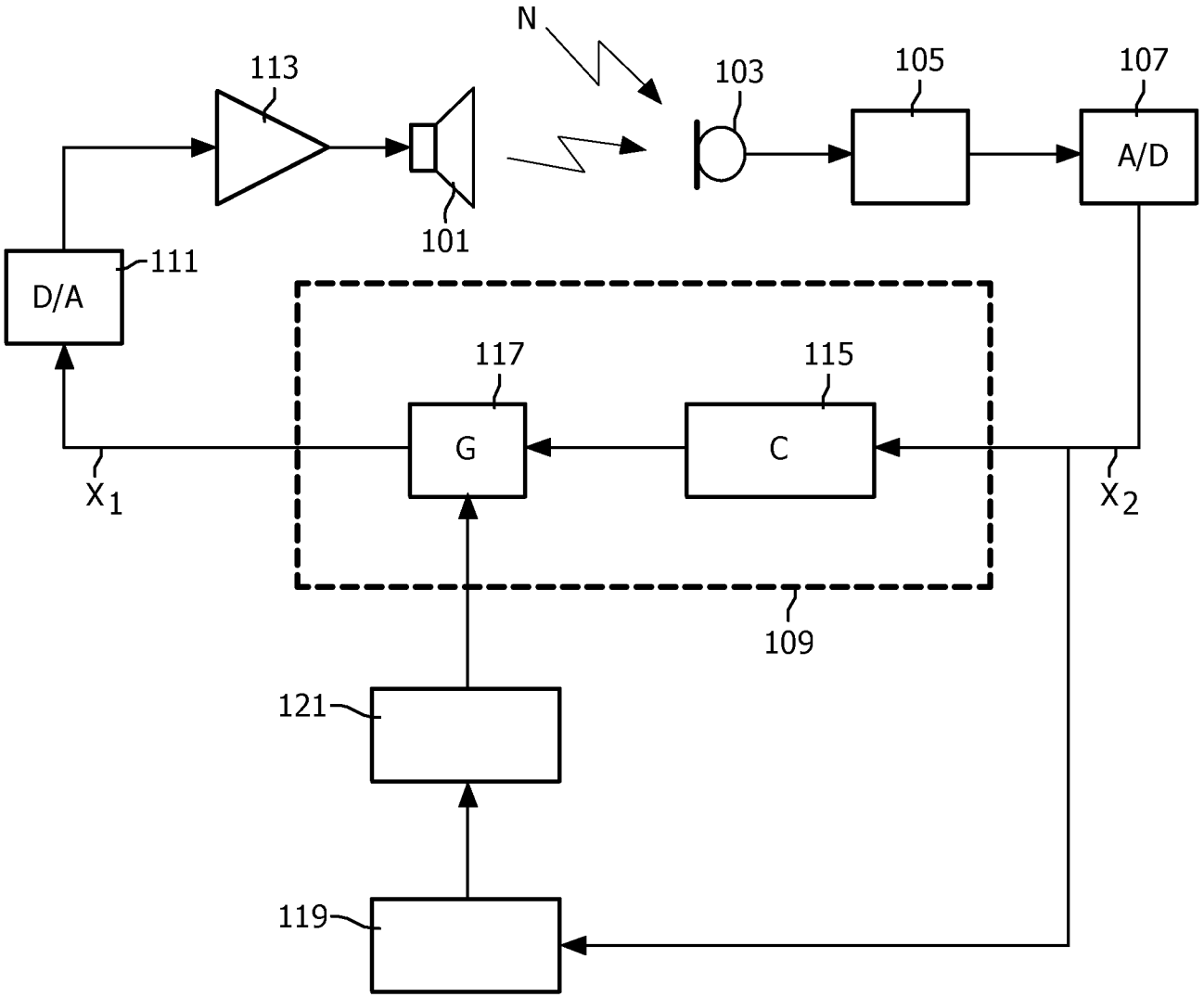
FIG. 1 illustrates an example of a noise canceling system in accordance with some embodiments of the invention.

FIG. 1 illustrates an example of a noise canceling system in accordance with some embodiments of the invention. In the specific example, the noise canceling system is a noise canceling system for a headphone. It will be appreciated that FIG. 1 illustrates the exemplary functionality for one ear and that identical functionality may be implemented for the other ear.

The noise canceling system comprises a sound transducer which in the specific example is a speaker 101 of the headphone. The system furthermore comprises a microphone 103 which is located close to the user's ear. In the specific example, the headphone may be a circumaural headphone which encloses the user's ear and with the microphone 103 mounted to capture the audio signal within the acoustic space formed around the user's ear by the circumaural headphone.

The goal of the noise canceling system is to attenuate or cancel sound perceived by the user and thus the system seeks to minimize the error signal e measured by the microphone 103. The use of a closed headphone may furthermore provide passive noise attenuation which tends to be particularly effective at higher frequencies. The active noise cancellation system of FIG. 1 is suitable for canceling noise by generating an anti-phase signal for the audio signal and feeding this to the speaker 101 for radiation into the acoustic environment perceived by the user. Thus, the microphone 103 captures an error signal which corresponds to the acoustic combination of the audio noise N that is to be cancelled and the noise cancellation signal provided by the speaker 101.

In order to generate the noise cancellation signal, the system of FIG. 1 comprises a feedback path from the output of the microphone 103 to the input of the speaker 101 thereby creating a closed feedback loop.

In the example of FIG. 1, the feedback loop is implemented mostly in the digital domain and accordingly the microphone 103 is coupled to an anti-aliasing filter 105 (typically including a low noise amplifier) which is further coupled to an Analog to Digital (A/D) converter 107.

The digitized signal is fed to a digital feedback filter 109 which is further coupled to a Digital to Analog (D/A) converter 111 which receives the filtered signal and converts it to the analog domain. In many embodiments the D/A converter 111 further includes an anti-aliasing filter (not shown) to smooth the generated analog signal. The analog signal from the D/A converter 111 is fed to a drive circuit 113 (typically including a power amplifier) which is coupled to the speaker 101 and which drives the speaker 101 to radiate the noise cancellation signal.

In the system, a feedback loop is thus created which includes a feedback filter 109 and a secondary path which comprises the elements that are not part of the feedback filter 109. The secondary path thus has a transfer function corresponding to the combined transfer function of the components of the feedback loop excluding the feedback filter 109. Hence, the transfer function of the secondary path corresponds to the transfer function of the (open loop) path from the output of the feedback filter 109 to the input of the feedback filter 109. In the specific example, the secondary path comprises the D/A converter 111, (including any D/A anti-aliasing filter), the drive circuit 113, the speaker 101, the acoustic path from the speaker 101 to the microphone 103, the anti-aliasing filter 105 and the A/D converter 107.

The noise canceling system of FIG. 1 furthermore comprises functionality for dynamically adapting the feedback loop in response to a tone (e.g. sine wave or approximate sine wave including harmonics thereof) characteristic for the feedback signal. In the example, the feedback signal is measured prior to the feedback filter 109 but it will be appreciated that it may in other embodiments be measured at other points of the feedback loop. Thus, the feedback signal may be the signal being fed back from the microphone 103 to the speaker 101 and may be measured at any point in the feedback path including before, after and in the feedback filter 109.

In the system of FIG. 1, the feedback filter 109 controls the closed loop behavior of the noise canceling system. The feedback filter 109 is specifically implemented as a loop filter 115 and a variable gain 117. In the implementation, the loop filter 115 provides the desired frequency response for the feedback path whereas the variable gain 117 provides a frequency invariant gain (within the operating frequency range of the system).

It will be appreciated that in some embodiments the variable gain 117 and the loop filter 115 may be implemented together, for example by the variable gain being achieved by varying the filter coefficients of the loop filter 115 (so as to modify the gain but not the frequency response, e.g. all coefficients of a FIR filter are scaled identically). It will furthermore be appreciated that in some embodiments the variable gain 117 and the loop filter 115 may be implemented as separate functional elements and may be located differently in the feedback loop. For example, the variable gain 117 may be located before the loop filter 115 or e.g. in the analog domain (e.g. it may be implemented as part of the drive circuit 113). It will also be appreciated that the feedback filter 109, and indeed the variable gain 117 and the loop filter 115, may be implemented as distributed functional elements and may represent functionality from any point in the feedback path from the microphone 103 to the transducer 101 including e.g. any analog filters.

Figure 2:
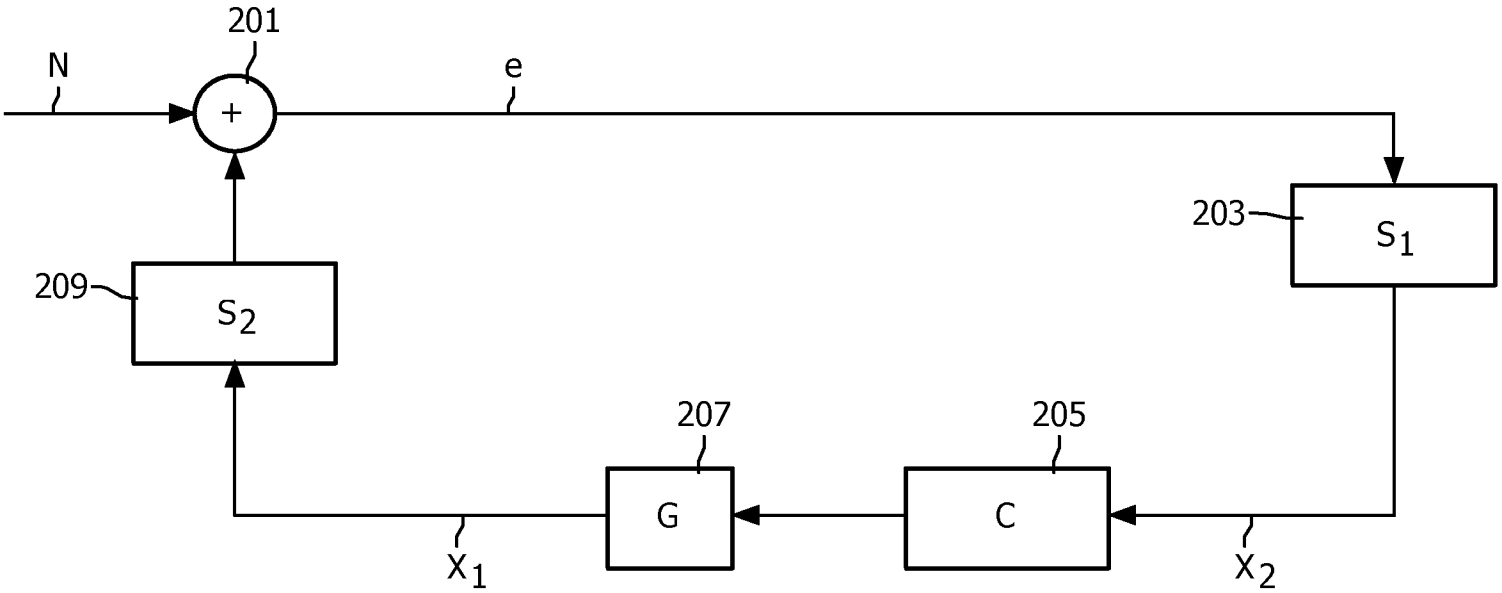
FIG. 2 illustrates an example of an analytical model for a noise canceling system.

FIG. 2 illustrates an analytical model of the system of FIG. 1. In the model, the audio summation performed by the microphone 103 is represented by a summer 201, the path from the microphone to the loop filter 115 is represented by a first secondary path filter ($s_1$) 203, the loop filter 115 is represented by a corresponding filter response 205, the variable gain 117 by a gain function 207 and the part of the secondary path from the variable gain 117 to the microphone 103 by a second secondary path filter ($s_2$) 209.

Figure 3:
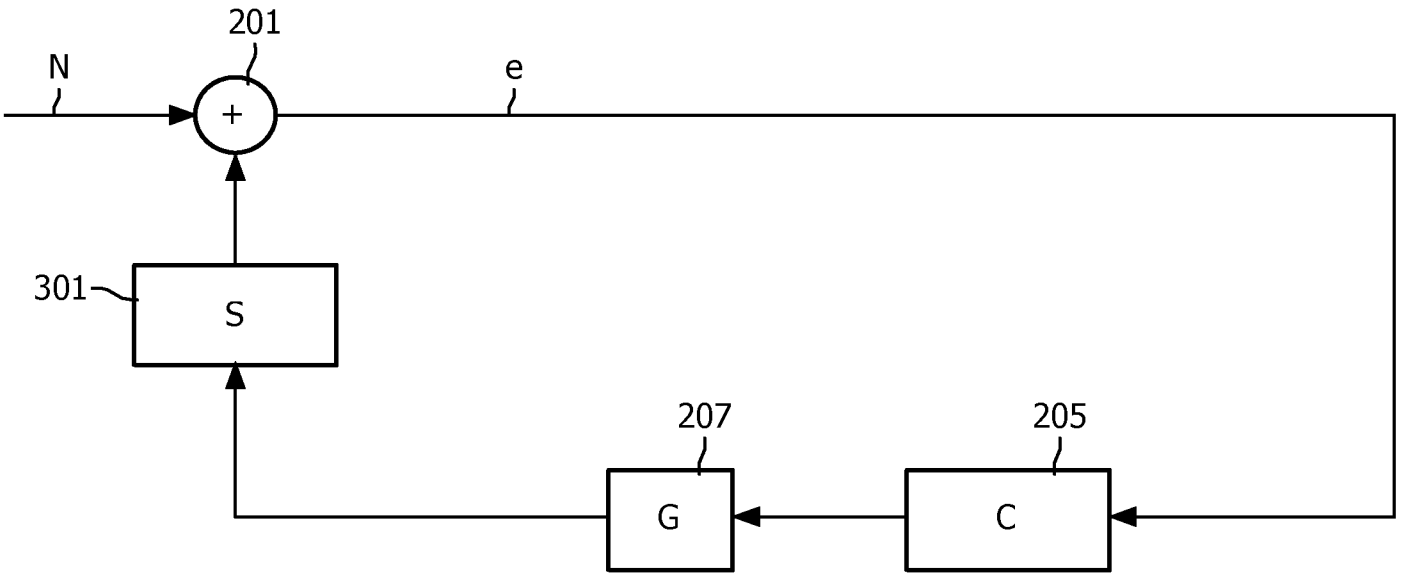
FIG. 3 illustrates an example of an analytical model for a noise canceling system.

In the model, the order of the elements of the feedback path may be interchanged and thus the first secondary path filter ($s_1$) 203 and the second secondary path filter ($s_2$) 209 may be combined into a single secondary path filter ($s=s_1 \cdot s_2$) 301 as shown in FIG. 3.

The closed loop transfer function E(f)/N(f) for the noise signal N can accordingly be determined as:

$$H(f) = \frac{E(f)}{N(f)} = \frac{1}{1 - G \cdot C(f) \cdot s_1(f) \cdot s_2(f)} = \frac{1}{1 - G \cdot C(f) \cdot s(f)}$$

or in the digital z-transform domain:

$$H(z) = \frac{E(z)}{N(z)} = \frac{1}{1 - G \cdot C(z) \cdot s_1(z) \cdot s_2(z)} = \frac{1}{1 - G \cdot C(z) \cdot s(z)}$$

The aim of the noise canceling system is to provide an overall transfer function H(f) (or H(z)) which attenuates the incoming signal as much as possible (i.e. resulting in the signal e captured by the microphone 103 being as low as possible).

In order to achieve efficient noise cancellation it is important to design the feedback filter 109 (G·C(f)) to provide an optimum closed loop performance. However, this design is significantly constrained by the fact that the feedback loop must remain stable for all scenarios and in particular for all possible changes in the secondary path S. Therefore, conventionally, worst case secondary path scenarios in which instability may occur are considered when designing the loop filter. However, although this may prevent or reduce the probability of instability it also provides a substantial constraint on the design freedom resulting in suboptimum filter design and degraded noise cancellation during normal operation.

For example, for many headphones, the characteristics and frequency of the secondary path changes very substantially for different operating configurations of the headphone. Indeed, very different responses are e.g. provided by headphones when they are not worn, when they are worn in a normal position, when pressed against the ears etc. For example, many noise canceling headphones substantially change the secondary path response around 1 kHz when the headphones are pressed against the head. Accordingly, instability may often occur around 1 kHz when the user presses the headphones against the head. In order to avoid this, the feedback filter can be designed to be stable in this configuration but this will result in substantially reduced noise cancellation when the headphones are not pressed against the head.

The system of FIG. 1 includes functionality for improving stability for different configurations with reduced degradation of the noise canceling performance for nominal configurations. Specifically, the noise canceling system of FIG. 1 is arranged to detect the onset of instability and to dynamically modify a characteristic of the feedback path in response to this detection. Specifically, the system comprises a tone processor 119 which determines a characteristic for a tone component of a feedback signal of the feedback loop from the microphone 103 to the transducer 101. Specifically, the tone processor 119 may detect whether a tone component with a sufficiently high signal level is present in the feedback signal, which specifically may be measured prior to the feedback filter 109.

The tone processor 119 is coupled to an adaptation processor 121 which is arranged to adapt a characteristic of the feedback path in response to the tone component characteristic. In the specific example, the adaptation processor 121 is coupled to the tone processor 119 and to the variable gain 117, and is arranged to adjust the gain of the variable gain 117 in response to the tone component characteristic.

In the example, the tone processor 119 comprises a tone detection function which is arranged to detect tone/sine wave components in the feedback signal. In typical environments audio noise to be cancelled has a very stochastic and noise like nature and does typically not contain any significant tone components. Accordingly, the inventor has realized that the detection of such tone components may be used in practice as an indication of the onset of an instability. The inventor has furthermore realized that the detection of such a tone component may be used to control the characteristics of the feedback path such that the onset of instability is countered. Specifically, when the tone processor 119 detects a tone component having a higher signal level than a given threshold, the gain of the variable gain 117 may be reduced thereby eliminating the positive feedback conditions and preventing the further onset of the instability.

Thus, in the system, the feedback characteristics are automatically modified when the occurrence of an instability is estimated. This modification changes the closed loop filter response to prevent the instability criterion from being met thereby resulting in the avoidance of feedback tones being generated. Furthermore, the loop filter need not be designed for worst case conditions but rather can be designed for nominal conditions with the active and dynamic instability mitigation operation compensating when unusual conditions may result in instability.

For example, the loop filter 115 may be designed for a nominal gain of the variable gain 117 and a nominal user configuration, such as headphones being worn normally. Thus, an improved noise cancellation may be achieved in this nominal use configuration. However, if the user presses the headphones against the head, the resulting beginning onset of instability is automatically detected and the gain is adjusted to avoid this instability and the resulting audio tones from developing further.

Thus, improved noise cancellation performance is achieved in most scenarios while at the same time achieving improved instability performance.

In the specific example, the tone processor 119 specifically comprises an Adaptive Line Enhancer (ALE). An ALE is particularly advantageous as it allows efficient, fast and accurate detection of low level tone/sine wave components in a signal and therefore allows a particularly advantageous detection of the onset of instability.

Figure 4:
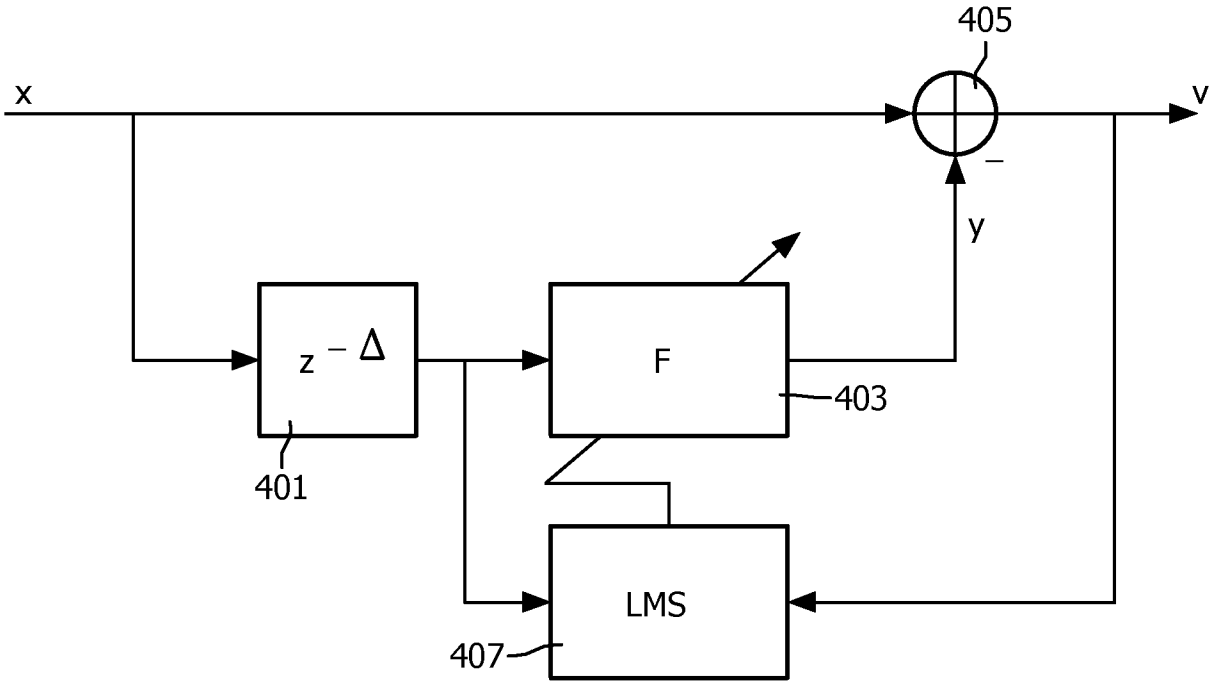
FIG. 4 illustrates an example of an adaptive line enhancer.

FIG. 4 illustrates an example of the tone processor 119 in accordance with an implementation using an ALE.

The tone processor 119 receives the feedback signal x which in the specific example corresponds to the digital signal being output from the A/D converter 107 and input to the feedback filter 109.

The feedback signal x is fed to a delay 401 and an adaptive filter 403 (it will be appreciated that the delay 401 and the adaptive filter 403 may be considered as a single adaptive filter providing both a sufficient delay and a filtering). The output signal y of the adaptive filter 403 is fed to a subtractor 405 which also receives the feedback signal x. The subtractor 403 generates the output signal v by subtracting the filter output signal y from the feedback signal x. Thus the output signal v is a difference indication for the feedback signal x and the modified signal y.

The ALE further comprises an adaptive filter controller 407 which receives the feedback signal x and the subtractor output signal v. The adaptive filter controller 407 is arranged to adapt the filter coefficients of the adaptive filter 403 such that the energy of the output signal is minimized. In the specific example, the adaptive filter controller 407 performs a Least Mean Squared Algorithm which adapts the coefficients such that the energy of the output signal v is minimized.

The delay 401 is set to be sufficiently large to avoid that stochastic noise is correlated between the input and output of the delay 401. Thus, the delay is set sufficiently high for the cross correlation between the feedback signal x and the output of the delay 401 to be below a given threshold for the stochastic noise components. Typically, the delay is set to be higher than 0.5 msecs and/or to be sufficient for the cross correlation to be zero or negligible. As a result, the adaptive filter 403 cannot filter the noise component output of the delay 401 to generate a signal that will be out of phase with the noise components of the feedback signal x. Thus, for stochastic noise components, the adaptive filter controller 407 cannot adapt the filter to reduce the energy of the subtractor output signal v.

However, for periodic signal components, such as in particular tone/sine wave components, the adaptive filter 403 can be adapted to generate an output signal y which directly matches the corresponding signal component in the feedback signal x. Thus, the minimization of the energy of the output signal by the adaptive filter controller 407 will result in the adaptive filter 403 being set to generate a tone that corresponds to the most significant tone component of the feedback signal x. In particular, the output signal y of the adaptive filter 403 will ideally be identical to the corresponding tone component in the feedback signal x. The subtraction of this component y from the feedback signal x will result in the output signal v having a minimized energy. Thus, the filter output signal y will correspond to the most significant tone component of the feedback signal x.

As a specific example, if the feedback signal x only contains stochastic noise, the coefficients of the adaptive filter 403 will converge to zero (provided that the delay is large enough to remove any noise auto correlation). If however, a sinusoidal signal component is present in the noise, the adaptive filter 403 will converge to a peak filter, which filters out the noise and outputs the sinusoidal signal. In this case, the subtractor output signal v only contains the stochastic noise without the sinusoidal/tone signal component.

The ALE provides a very reliable, accurate and fast detection of the presence of tone components in the input signal. Thus, the ALE may be very efficient in detecting the presence of potentially low level tone components that may arise due to the onset of instability. Indeed, as mentioned, noise canceling headset may often have an instability in some configurations resulting in clearly perceptible and annoying tones around 1 kHz. The ALE is very fast in detecting such tones and in the system the onset of such tones in the feedback signal are detected and used to compensate the feedback path to counter the instability.

In the example the tone component characteristic is determined in response to the output signal y of the adaptive filter 403. Specifically, the tone component characteristic may be determined as a characteristic of this signal.

In the specific example, the tone component characteristic is determined as a level indication which is indicative of the signal level of the output signal y of the adaptive filter 403. This may provide a particularly efficient and reliable indication of the likelihood of the onset of instability as a sufficiently high level of any tone components in the signal are likely to indicate that this tone component is generated by an instability.

Alternatively or additionally, the tone component characteristic may be determined in response to a characteristic of at least one coefficient of the adaptive filter. For example, for a Finite Impulse Response (FIR) filter, the tone component characteristic may be set to correspond to the highest absolute coefficient value and/or a sum absolute coefficient value. Thus, the tone component characteristic may for example be calculated as a magnitude level indication for one or more coefficients of the adaptive filter 403.

Such a filter coefficient based characteristic may in many scenarios provide a particularly advantageous indication of the presence of instability induced tone components as it directly reflects the adaptation of the ALE to the current signal.

The tone component characteristic is fed to the adaptation processor 121 which proceeds to adapt a characteristic of the feedback path in response. In the specific case, the adaptation processor 121 adjusts a characteristic of the feedback filter 109.

It will be appreciated that in some embodiments, the frequency response of the feedback filter 109 may be adjusted. However, in the specific example, a low complexity adjustment of a gain value of the variable gain 117 is used to modify the feedback filter 109 and thus the characteristic of the feedback path from the microphone 103 to the transducer 101.

Specifically, the adaptation processor 121 is arranged to bias the gain towards lower gains for a tone component characteristic indicative of an increasing signal level of the tone signal component.

For example, if the adaptation processor 121 receives a signal level indication from the ALE which indicates that a tone component has a level below a given first threshold, this is likely to indicate that there is no instability occurring and thus a given nominal gain value may be set. However, if the signal level indication indicates that a tone component is above a given threshold (which may, but need not, be the same threshold as the first threshold), this may be taken to indicate that an instability is developing and accordingly the gain of the variable gain 117 may be reduced to a lower value that results in the instability conditions of the feedback loop being eliminated. For example, the variable gain 117 may be set to a value which is known to not cause instability even if the headphones are pressed against the ears. The gain value may then be returned to the nominal value if the tone component level falls below the first value.

It will be appreciated that many other algorithms or criteria for setting the gain as a function of the tone component characteristic may be used without detracting from the invention. For example, a look-up table may be used to implement any relationship between the tone component characteristic and the gain. As another example, there may not be a direct absolute correlation between the tone component characteristic and the gain value but rather a relative setting of the gain may be used. For example, when a tone component signal level above a given level is detected, the adaptation processor 121 may proceed to continuously reduce the gain at a given rate until the tone component level has fallen below a given threshold.

As is clear from the analytical models of FIG. 2 and FIG. 3 as well as the associated analytical derivations, the closed loop response is highly dependent on the gain G and thus the resulting closed loop response can be effectively controlled merely by adjusting the gain. It is also clear that instabilities can be avoided by adjusting the gain. For example, no instability can occur if the gain is set to zero as this corresponds to there being no feedback path. Thus, reducing the gain sufficiently will always allow the removal of an instability.

However, it will be appreciated that in other embodiments, other characteristics of the feedback path may alternatively or additionally be adjusted in order to avoid instabilities from developing. For example, the loop filter 205 may be an adaptive filter which is adapted to provide a different frequency response when the onset of an instability has been detected.

For example, if the ALE detects a tone component at a given frequency, the loop filter 205 may be adjusted to introduce a high attenuation at this frequency. For example, a notch at the given frequency may be introduced to the frequency response of the loop filter 205. This may effectively attenuate the feedback resulting in the instability while at the same time allowing efficient noise cancellation at other frequencies. Thus, in this example the tone component characteristic may include or correspond to a frequency of a detected tone component, and the feedback frequency response may be modified to attenuate this frequency.

In some embodiments, the noise canceling system further comprises a filter to generate a filtered signal which is then used by the tone signal component processor 119 to generate the tone component characteristic. Thus, the tone component characteristic may be generated in response to a characteristic of the filtered signal. The filtered signal may specifically be generated by filtering the feedback signal, such as e.g. the feedback signal at the input to the feedback filter 109.

Figure 5:
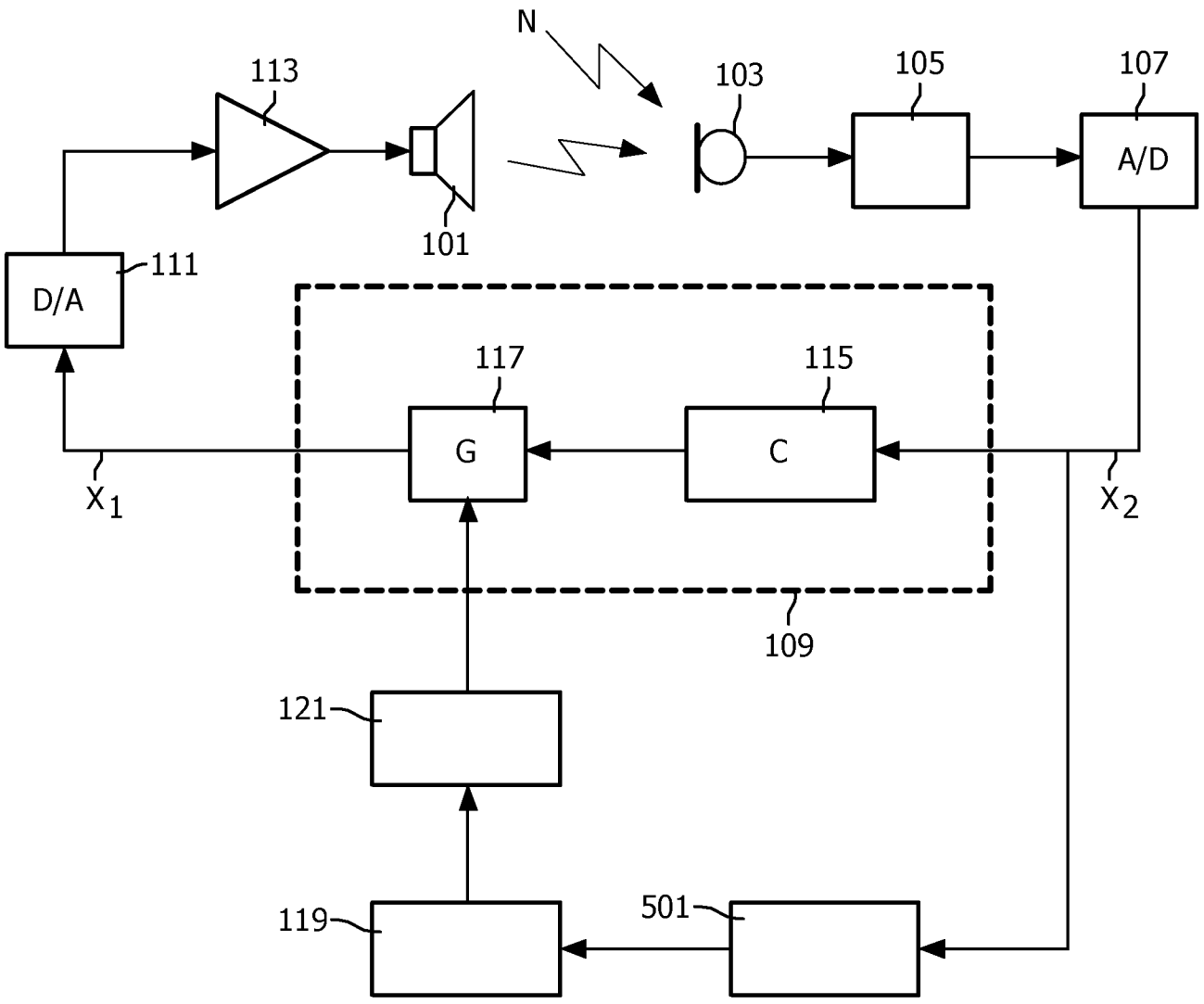
FIG. 5 illustrates an example of a noise canceling system in accordance with some embodiments of the invention.

Such an example is illustrated in FIG. 5. In the example, the noise canceling system of FIG. 1 is modified to further include a filter 501 which filters the input signal to the tone processor 119.

The filter is specifically a bandpass filter which has a passband that corresponds to a frequency interval in which instabilities are likely to occur. For example, for the application of a headphone noise cancellation system wherein pressing the headphones to the head is likely to generate a positive feedback around 1 kHz, the filter 501 is designed to attenuate frequencies in an appropriate frequency interval around 1 kHz.

In many embodiments, advantageous performance can be achieved by selecting a 6 dB pass band of not more than 500 Hz for the filter 501 but it will be appreciated that different pass bands may be used in different embodiments.

The introduction of a filter 501 at the input to the tone processor 119 may provide improved performance in many scenarios. In particular, it may improve the probability of correctly detecting the onset of an instability while reducing the probability of false detections. Specifically, the detection of tone components may be restricted to frequency intervals in which such tone components are likely to arise due to instabilities. Thus, the filter 501 can e.g. reduce the risk that an audio noise tone will be detected as an instability as it is likely to be at different frequencies.

In some embodiments, the filter 501 may comprise a plurality of pass bands. Specifically, the filter 501 may comprise a plurality of parallel band pass filters with each filter generating a filtered signal in a given frequency interval. The filter 501 may furthermore comprise a combiner (e.g. a simple summation circuit) for combining the output signals of the individual filters, and this combined signal is then fed to the tone processor 119. Thus, in such an embodiment, a low complexity approach can be used to optimize the system for protection against instability in a plurality of specific frequency intervals in which instabilities are likely to occur. For example, a headphone may be likely to provide an instability when pressed against the head, or when lifted slightly away from the ear by a user. These two instabilities may occur at different frequencies and a filter 501 having a plurality of pass bands may be able to reliable detect both types of instability while still having a high resistance to false detection caused by tone components in the audio environment.

In the previous description, the feedback path is mainly implemented digitally and in particular the feedback filter 109 as well as the instability protection circuitry is digitally implemented. However, it is appreciated that in other embodiments other splits between analog and digital functionality may be applied including e.g. a completely analog implementation.

Figure 6:
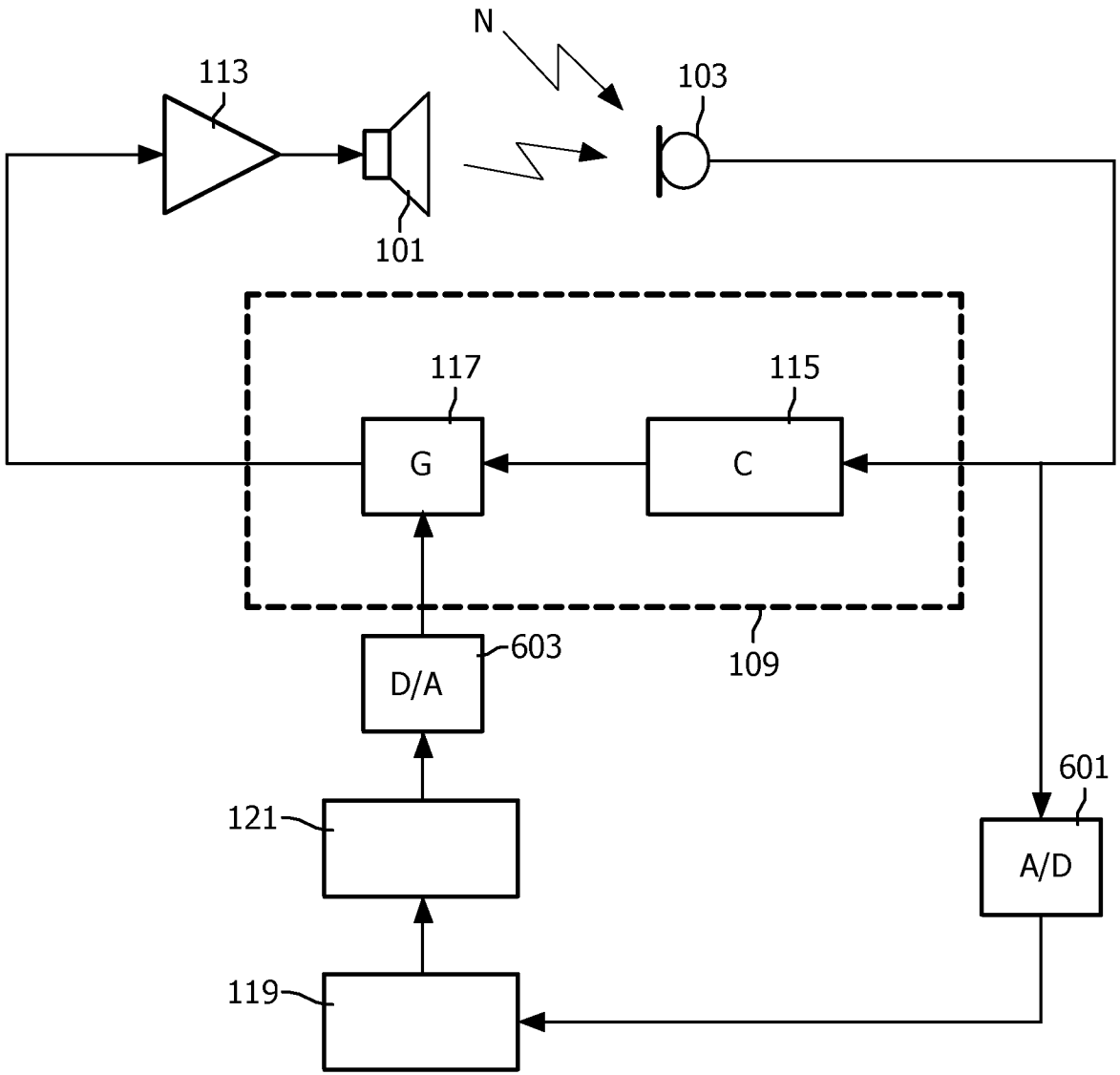
FIG. 6 illustrates an example of a noise canceling system in accordance with some embodiments of the invention.

In some embodiments, the feedback filter and indeed the entire feedback path from the microphone 103 to the transducer 101 is implemented in analog whereas the instability protection circuitry in the form of the tone processor 119 and the adaptation processor 121 are digitally implemented. For example, the input to the tone processor 119 may include an A/D converter 601 (including an anti-aliasing filter) and the output of the adaptation processor 121 may include a D/A converter (which may include an anti-aliasing filter) as illustrated in FIG. 6.

It will be appreciated that in some embodiments only parts of the tone processor 119 and/or the adaptation processor 121 will be implemented digitally whereas other parts of the tone processor 119 and/or the adaptation processor 121 are implemented by analog circuit. For example, for the ALE of FIG. 4, the delay 401, the adaptive filter 403 and the adaptive filter controller 407 may be implemented in the digital domain whereas the subtractor 405 is implemented in the analog domain. In such an example, the inputs to the delay 401 and the adaptation filter controller 407 may include A/D converters and the output from the adaptive filter 403 may include a D/A converter (including suitable anti-aliasing filters where appropriate). Such an example may be particularly advantageous in scenarios where the subtractor 405 is implemented as part of the feedback path as will be described later, and where the feedback path is in the analog domain.

In the previous examples, the instability protection functionality has not directly modified the feedback signal but has rather controlled the feedback path. In particular, the tone processor 119 and adaptation processor 121 have not been part of the feedback path itself.

However, it will be appreciated that in other embodiments, the tone processor 119 and/or the adaptation processor 121 may itself be part of the feedback path and may directly modify the feedback signal.

Figure 7:
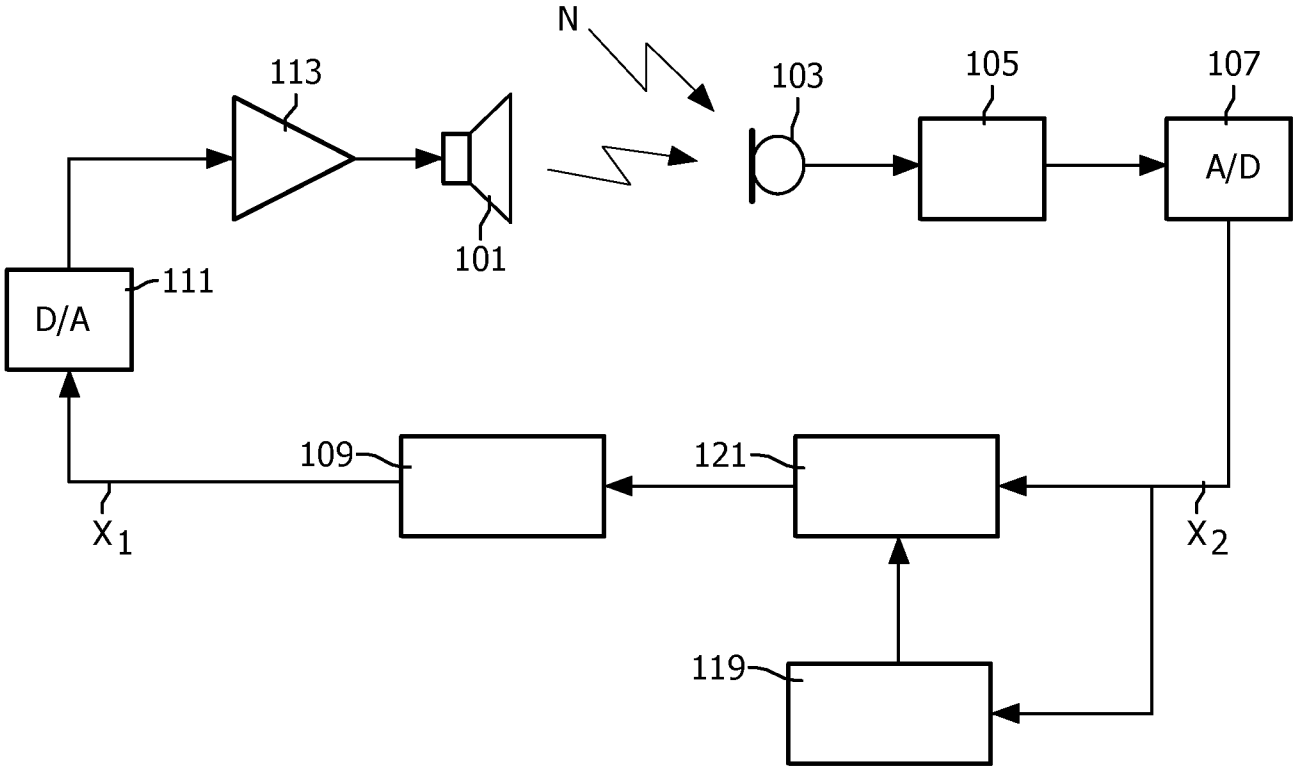
FIG. 7 illustrates an example of a noise canceling system in accordance with some embodiments of the invention.

An example wherein the adaptation processor 121 is directly inserted in the feedback path is illustrated in FIG. 7. In the example, the adaptation processor 121 does not control the frequency response or gain of the feedback filter 109 but rather directly modifies the feedback signal in case an instability is detected.

For example, during normal operation, the tone processor 119 will not detect any significant tone components in the feedback signal and in this scenario, the adaptation processor 121 may simply pass through the feedback signal without modifying it. However, if the tone processor 119 detects a tone component that is likely to arise from an instability, it may feed this to the adaptation processor 121 which proceeds to try to suppress this tone component. For example, the frequency of a detected tone component may be fed to the adaptation processor 121 which then proceeds to perform a sharp notch filtering centered at that frequency. As another example, the adaptation processor 121 may suppress the detected tone component by subtracting the estimated tone component from the feedback signal.

Figure 8:
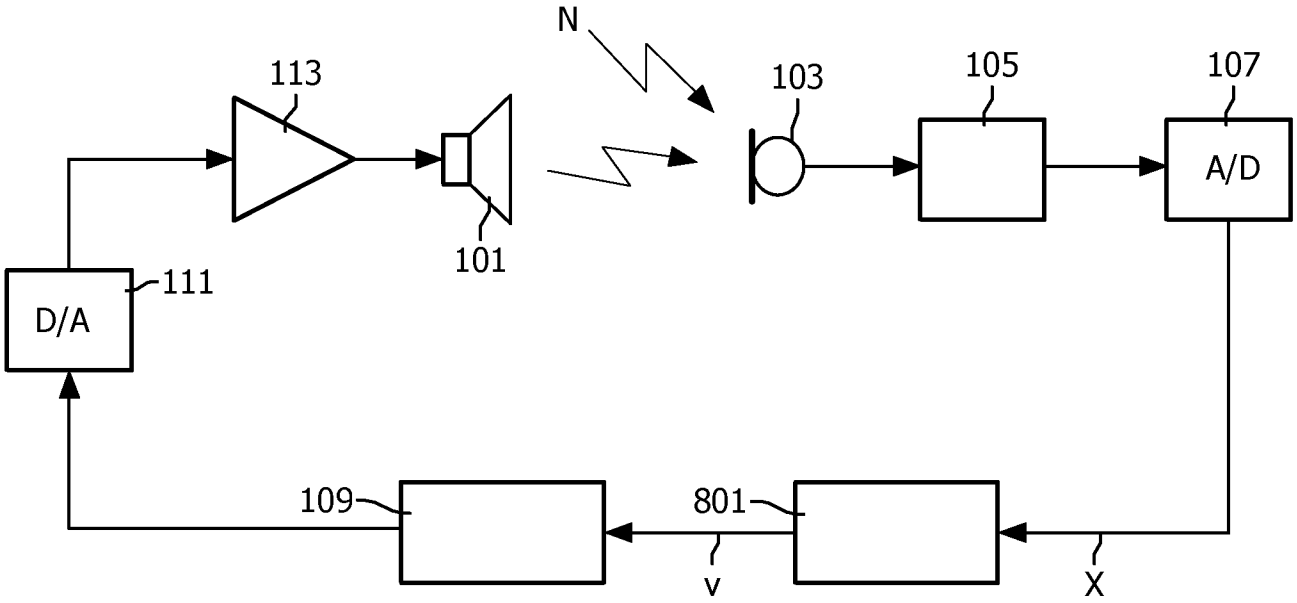
FIG. 8 illustrates an example of a noise canceling system in accordance with some embodiments of the invention.

A particularly advantageous system can be achieved by directly including an ALE in the feedback path. For example, as illustrated in FIG. 8, the ALE 801 of FIG. 4 may directly be inserted in the feedback path. This may provide efficient performance while maintaining low complexity. Indeed, the ALE may not only allow efficient detection of instability caused tone components but also automatically introduce a suppression or possible elimination of these from the feedback signal.

For example, during normal operation, the feedback signal is predominantly stochastic noise and accordingly the LMS algorithm of the adaptive filter controller 407 will tend to drive the adaptive filter 403 towards zero coefficients resulting in the ALE 801 operating as a simple pass through and not affecting the signal. However, if a tone component is present, the adaptive filter controller 407 will control the adaptive filter 403 to generate an output y that corresponds to this tone component. This signal is furthermore fed to the subtractor 405 which results in the tone component being suppressed in the feedback signal being output from the ALE 801.

It will be appreciated that the example of FIG. 8 corresponds directly to the example of FIG. 7 with the adaptation processor 121 corresponding to the subtractor 405 of the ALE 801 and the tone processor 119 corresponding to the delay 401, the adaptive filter 403 and the adaptive filter controller 407.

Figure 9:
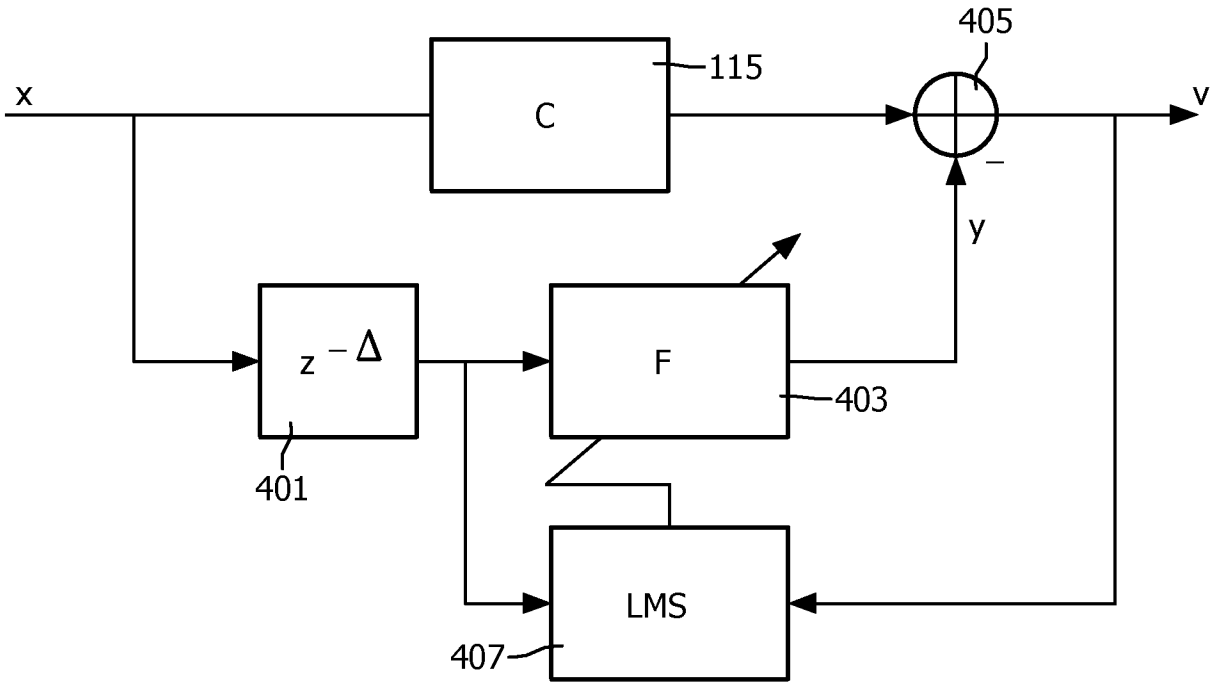
FIG. 9 illustrates an example of a noise canceling system in accordance with some embodiments of the invention.

Another example is provided in FIG. 9. In this example, the loop filter 115 is in parallel with the tone detection functionality of the ALE of FIG. 4. It will be appreciated that the example of FIG. 9 also corresponds directly to the example of FIG. 7 with the adaptation processor 121 corresponding to the subtractor 405 of the ALE, and the tone processor 119 corresponding to the delay 401, the adaptive filter 403 and the adaptive filter controller 407; but with the adaptation processor 121 moved to between the loop filter 115 and the variable gain 117.

Thus, in these examples, the adaptation processor 121 directly changes the feedback path by itself being a part of the feedback path and adapting the processing of the feedback signal in response to the detection of tone components.

The approach may be highly advantageous in many embodiments and may in particular allow efficient instability mitigation while maintaining low complexity. Furthermore, instability compensation may be directly aimed at the instability itself with reduced impact on noise canceling performance at other frequencies.

It will further be appreciated that the approaches may be combined. For example, the adaptation processor 121 of FIG. 7 may in addition to suppressing the detected tone component also modify the gain of the variable gain 117 of the feedback filter 109.

In some systems, the loudspeaker 101 may also be used to provide a user audio signal to the user. For example, the user may listen to music using the headphones. In such systems, the user audio signal is combined with the feedback loop signal (e.g. at the input to the D/A converter 111) and the error signal from the microphone 103 is compensated by subtracting a contribution corresponding to the estimated user audio signal captured by the microphone 103.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable circuit for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of circuit, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A noise canceling system comprising:

a microphone configured to capture an audio signal representing sound in an audio environment;

a sound transducer configured to radiate a sound canceling audio signal in the audio environment;

a first feedback path from the microphone to the sound transducer, the first feedback path comprising a feedback filter having a loop filter configured to receive the captured audio signal and a variable gain circuit configured to generate a drive signal for the sound transducer from the filtered captured audio signal; and a second feedback path from the microphone to the sound transducer, the second feedback path comprising a tone processor configured to determine a tone component characteristic for a tone component of the captured audio signal, and an adaptation circuit configured to adapt a gain of the variable gain circuit in response to the determined tone component characteristic.

2. The noise canceling system of claim 1, wherein the tone component characteristic is a signal level of the tone component.

3. The noise canceling system of claim 1, wherein the adaptation circuit is arranged to adapt the gain of the feedback filter in response to the tone component.

4. The noise canceling system of claim 1, wherein the tone processor comprises an adaptive line enhancer.

5. The noise canceling system of claim 4, wherein the adaptive line enhancer comprises:

an adaptive filter configured to delay and filtering an input signal to generate a modified signal;

a comparator configured to generate a difference indication by comparing the input signal to the modified signal; and a circuit configured to adapt the adaptive filter to minimize the difference indication.

6. The noise canceling system of claim 5, wherein the tone processor is arranged to generate the tone component characteristic in response to a characteristic of the modified signal.

7. The noise canceling system of claim 5, wherein the tone processor is arranged to generate the tone component characteristic in response to a characteristic of at least one coefficient of the adaptive filter.

8. The noise canceling system of claim 1, wherein the adaptation circuit is arranged to adapt the gain of the feedback filter in response to the tone component characteristic.

9. The noise canceling system of claim 8, wherein the adaptation circuit is arranged to bias the gain towards lower gains for a tone component characteristic indicative of an increasing signal level of the tone signal component.

10. The noise canceling system of claim 1, further comprising a filter to generate a filtered signal and wherein the tone processor is arranged to generate the tone component characteristic in response to the filtered signal.

11. The noise canceling system of claim 1, wherein the adaptation circuit is arranged to adapt a frequency response of the feedback filter.

12. The noise canceling system of claim 1, further comprising a suppression circuit configured to suppress a signal component of the captured signal, the signal component having a characteristic corresponding to the tone component characteristic.

13. The noise canceling system of claim 1, wherein the tone processor and the adaptation circuit are part of an Adaptive Line Enhancer.

14. The noise canceling system of claim 1, wherein at least part of the tone processor is implemented digitally.

15. A method of operation for a noise canceling system including: a microphone for capturing an audio signal representing sound in an audio environment, a sound transducer for radiating a sound canceling audio signal in the audio environment, the method comprising acts of:

providing a first feedback path from the microphone to the sound transducer, the first feedback path comprising a feedback filter having a loop filter and a variable gain circuit;

over the first feedback path receiving, using the feedback filter, the captured audio signal;

generating, using the variable gain circuit, a drive signal for the sound transducer;

providing a second feedback path from the microphone to the sound transducer, the second feedback path comprising a tone processor and an adaptation circuit;

over the second feedback path determining, using the tone processor, a tone component characteristic for a tone component of the captured signal of the feedback path; and adapting, using adaptation circuit, a gain of the variable gain circuit in response to the tone component characteristic.

16. The method of claim 15, wherein the tone component characteristic is a signal level of the tone component, and wherein the adaptation circuit is arranged to adapt the gain of the feedback filter in response to the tone component.

17. The method of claim 15, wherein the tone processor comprises:

an adaptive filter for delaying and filtering an input signal to generate a modified signal;

a comparator for generating a difference indication by comparing the input signal to the modified signal; and a circuit for adapting the adaptive filter to minimize the difference indication.

18. The method of claim 17, wherein the tone processor is arranged to generate the tone component characteristic in response to one of a characteristic of the modified signal and a characteristic of at least one coefficient of the adaptive filter.

19. The method of claim 15, wherein the adaptation circuit is arranged to adapt the gain of the feedback filter in response to the tone component characteristic.

20. The method of claim 19, wherein the adaptation circuit is arranged to bias the gain towards lower gains for a tone component characteristic indicative of an increasing signal level of the tone signal component, and wherein the adaptation circuit is arranged to adapt a frequency response of the feedback filter.

* * * * *